United States Patent [19]

Carey

[11] 4,423,583

[45] Jan. 3, 1984

[54] PACKAGING MACHINE WITH POUCH GRIPPING CLAMPS

[75] Inventor: Norman W. Carey, Sarasota, Fla.

[73] Assignee: Rexham Corporation, New York, N.Y.

[21] Appl. No.: 286,180

[22] Filed: Jul. 23, 1981

[51] Int. Cl.[3] ..... B65B 51/14

[52] U.S. Cl. ..... 53/373; 53/384; 53/570; 493/206

[58] Field of Search ..... 53/373, 479, 550, 562, 53/568, 570, 384; 493/206, 209

[56] References Cited

U.S. PATENT DOCUMENTS

| | | | |
|---|---|---|---|
| 2,649,673 | 8/1953 | Bartelt | 53/562 |
| 3,195,285 | 7/1965 | Toss | 53/479 |
| 3,269,524 | 8/1966 | Canfield | 198/180 |
| 3,381,446 | 5/1968 | Marchand | 53/562 |
| 3,420,034 | 1/1969 | Sarisky | 53/568 |
| 3,553,934 | 1/1971 | Johnson | 53/562 |
| 3,568,402 | 3/1971 | Lense et al. | 53/384 |
| 3,968,629 | 7/1976 | Gidewall | 53/373 |
| 4,081,942 | 4/1978 | Johnson | 53/434 |

*Primary Examiner*—John Sipos

*Attorney, Agent, or Firm*—Leydig, Voit, Osann, Mayer & Holt, Ltd.

[57] ABSTRACT

Flexible pouches filled with product are gripped at their side margins by bag clamps and are advanced to a steaming station where steam is directed downwardly toward the pouches to drive air therefrom. As the steam is being introduced into each pouch, the pouch is held in a widely open position by the clamps. Thereafter, the pouch is closed by shifting one clamp away from the other clamp and then is sealed by heated sealing bars. To enable a substantially wrinkle-free top seal to be formed, each clamp includes upper and lower jaws which grip the pouch above and below the bottom margin of the top seal to keep the seal area tight.

2 Claims, 5 Drawing Figures

PACKAGING MACHINE WITH POUCH GRIPPING CLAMPS

BACKGROUND OF THE INVENTION

This invention relates generally to a packaging machine and more particularly to a packaging machine for filling flexible pouches with product, purging air from the filled pouches, and then sealing the pouches.

In the packaging of certain products, and particularly food products, the filled and sealed pouches are delivered to an autoclave or retort and are heated to high temperatures so as to sterilize the product in the pouches. In order for this packaging process to be successful, it is important that the sealed pouch be substantially free of air when the pouch is delivered to the autoclave. If any significant amount of air is present in the pouch, the air will expand when subjected to the high temperatures in the autoclave and will cause the pouch to balloon, such ballooning sometimes destroying the seals of the pouch. Even if the pouch is not subjected to autoclaving, it is often desirable to remove the air from the pouch so that the product will be packaged in an oxygen-free environment and will possess a long stable shelf life.

One method of removing air from pouches is disclosed in Johnson U.S. Pat. No. 4,081,942. In the system disclosed in the Johnson patent, the pouches are held at their side margins by bag clamps and are advanced beneath a steam nozzle by the clamps. While each pouch is held in a widely open position by the clamps, a downward flow of steam from the nozzle is introduced into the pouch to drive air out of the pouch. Thereafter, one of the clamps is moved away from the other clamp to draw the upper end of the pouch to a flattened, closed position. Heated seal bars then engage and seal the closed upper end portion of the pouch to prevent air from entering the pouch.

While the steam is beneficial from the standpoint of helping to reduce the air content of the pouches, the steam makes it difficult to form wrinkle-free top heat seals along the upper end portions of the pouches. The steam tends to soften and wilt the upper end portions of the pouches and thus makes the pouches susceptible to wrinkling.

SUMMARY OF THE INVENTION

The general aim of the present invention is to provide a packaging machine having new and improved bag clamps which more effectively grip the top seal area of the pouch to enable a substantially wrinkle-free top seal to be formed in spite of the wilting action of the steam.

A more detailed object is to provide bag clamps having uniquely spaced upper and lower jaws which grip the pouch above and below the bottom margin of the top seal so as to keep the upper end portion of the pouch tight and substantially flat during formation of the seal.

The invention also resides in the novel correlation between the shape of the top seal bars and the location of the clamp jaws to enable effective sealing of the pouch areas between the upper and lower jaws.

These and other objects and advantages of the invention will become more apparent from the following detailed description when taken in conjunction with the accompanying drawings.

DETAILED DESCRIPTION OF THE PREFERRED EMBODIMENT

Figure 1:
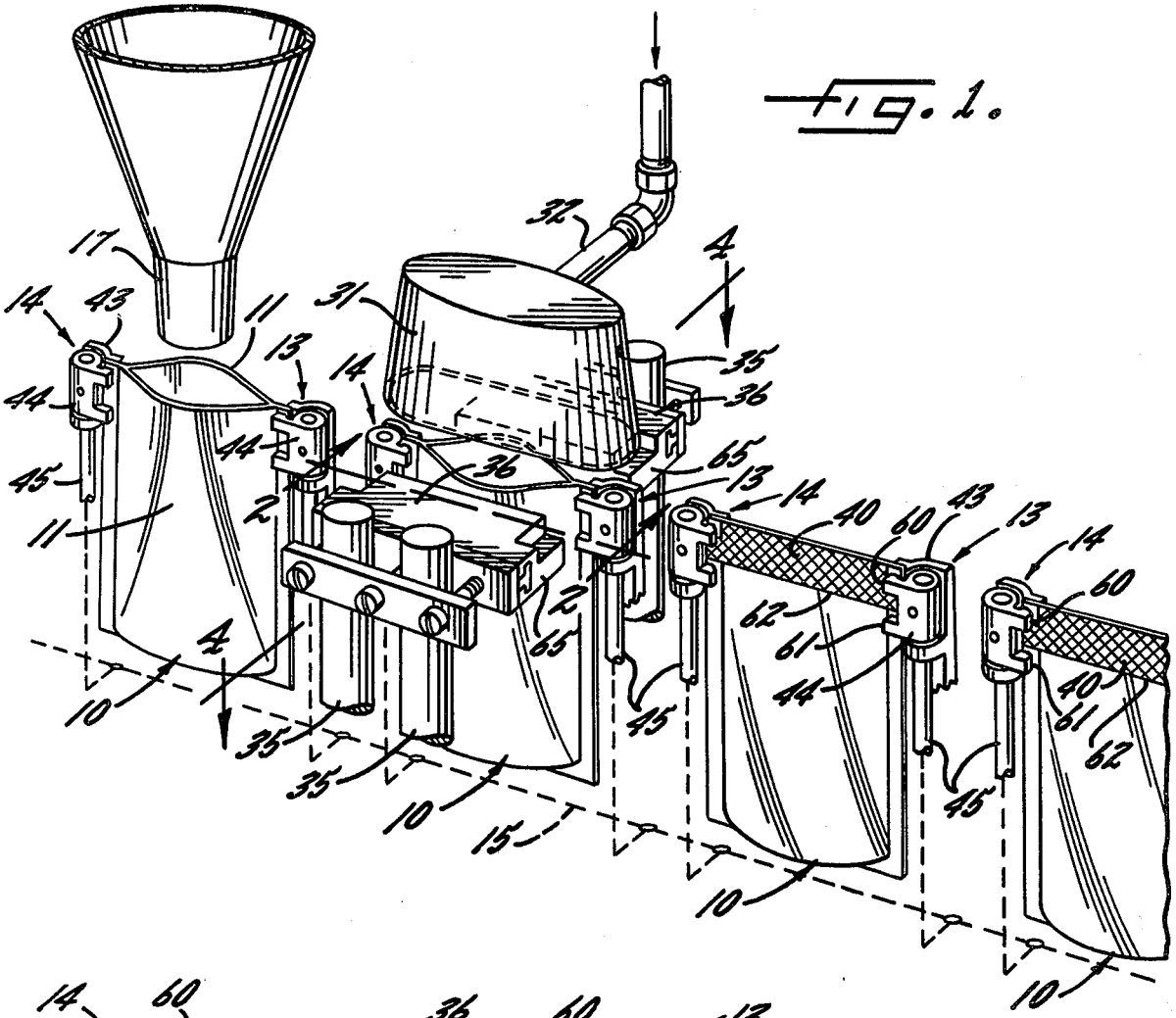
FIG. 1 is a fragmentary perspective view of a packaging machine having new and improved bag clamps incorporating the unique features of the present invention.

As shown in the drawings for purposes of illustration, the invention is embodied in a packaging machine for filling and sealing envelope-type pouches 10. Such a pouch usually is made from a single or composite sheet of flexible material having at least one side which is heat sealable. The pouch includes two flexible panels 11 which are sealed or otherwise joined together along their side and bottom margins, the upper end of the pouch being open until the pouch is filled and sealed.

Figure 4:
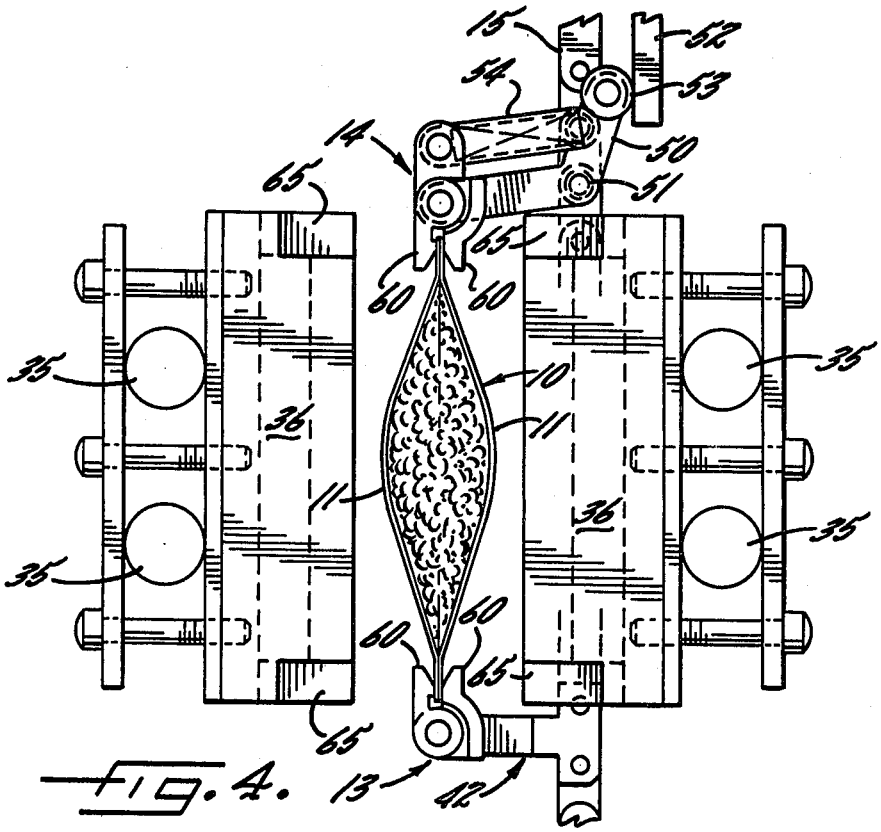
FIG. 4 is an enlarged fragmentary cross-section taken substantially along the line 4—4 of FIG. 1 and shows the pouch in an open position prior to the pouch being sealed.

In many respects, the packaging machine is similar to that disclosed in Johnson et al U.S. Pat. No. 3,553,934 and thus certain elements of the machine need not be described in detail. In general, each pouch 10 is adapted to be gripped releasably at its side margins by leading and trailing clamps 13 and 14 which are carried on a chain 15 (FIGS. 1 and 4). The latter is adapted to be advanced intermittently by a drive mechanism (not shown) and, as the chain is advanced along a predetermined path, the pouches are moved into and momentarily dwell at a series of horizontally spaced stations where packaging operations are performed on the pouches. The pouches herein are advanced in spaced edgewise relation and are held with their open ends facing upwardly. In the present instance, the pouches are relatively large and having a capacity of, for example, from one to three liters.

Herein, the machine includes a filling station having a dispenser spout 17 (FIG. 1) for depositing a product into each pouch 10 as the latter dwells beneath the spout. In one particular packaging operation, the product which is discharged through the spout is a particulate solid product such as peas which may be cold or slightly warm. To facilitate dispensing of the product into the pouch, the trailing clamp 14 is adapted to be shifted toward the leading clamp 13 and, when the trailing clamp is so shifted, it causes the panels 11 of the pouch to bow outwardly and open the upper end portion or mouth of the pouch as shown in FIGS. 1 and 4.

After being filled, each pouch 10 advances to and dwells in a steaming station where dry steam at a temperature of approximately 375 degrees F. and at a pressure of about 3 p.s.i. is introduced into the pouch through a nozzle 31 (FIG. 1) when the pouch first dwells and while the upper end of the pouch is still held open by the trailing clamp 14. The steam drives air and gases out of the pouch for the purposes which have been explained previously. As shown in FIG. 1, the steam nozzle 31 is located just above the upper end of each pouch which dwells in the steaming station and is of an elongated shape so as to discharge the steam across substantially the entire length of the mouth of the pouch. Steam is admitted continuously into the nozzle through a pipe 32.

Figure 5:
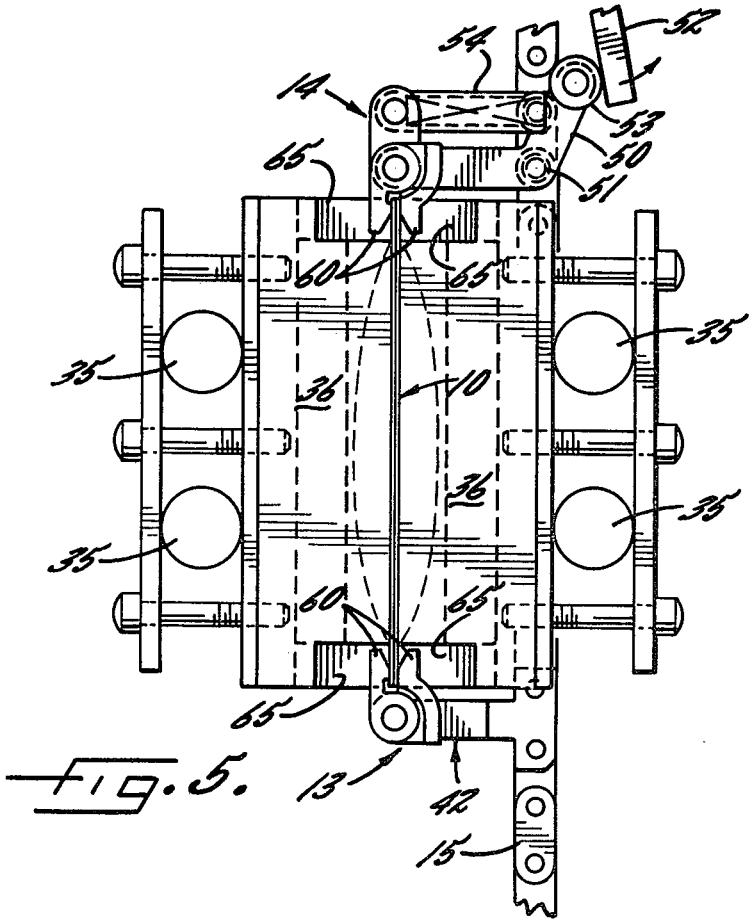
FIG. 5 is a view similar to FIG. 4 but shows the pouch in a closed position and being sealed.

After the pouch 10 has been filled with steam, the trailing bag clamp 14 is shifted away from the leading clamp 13 to close the upper end portion of the pouch (see FIG. 5). Thereafter, the upper end portion of the pouch is sealed. The closing and sealing operations preferably but not necessarily are performed while the pouch is in the sealing station and before the pouch is advanced from beneath the steam nozzle 31.

In order to seal the pouch 10, two upright rods 35 are located on each side of the pouch and are adapted to be moved toward and away from the pouch by conventional mechanism (not shown). Carried on the rods 35 are two opposing heat sealing bars 36 (FIG. 4) which are equipped with electrical heating elements. When the rods are retracted outwardly, the sealing bars are located outwardly of the pouch as shown in FIG. 4 and, when the rods are shifted fully inwardly (FIG. 5), the sealing bars engage the upper end portions of the side panels 11 of the pouch 10 to form a heat seal 40 along the top of the pouch.

While the steam is effective to remove air from the pouch 10, the steam also heats and moistens the upper end portion of the pouch and causes the top of the pouch to wilt or become extremely limp. As a result, difficulty has been encountered in forming top seals which are free of wrinkles and blisters.

In accordance with the present invention, the bag clamps 13 and 14 are uniquely constructed so as to grip the top portion of the pouch 10 at vertically spaced locations and to tightly draw the top of the pouch into a virtually flat and planar condition prior to the time the pouch is engaged by the seal bars 36. As a result, the bag clamps prevent the upper end portion of the pouch from drooping or buckling and enable a more wrinkle-free top seal to be formed.

More specifically, each of the bag clamps 13 and 14 comprises a main body 42 (FIG. 3), a fixed jaw structure 43 attached rigidly to the body and a movable jaw structure 44 adapted to pivot between open and closed positions relative to the fixed jaw structure. Herein, the movable jaw structure of each clamp is connected to the upper end portion of an upright shaft 45 which is rotatably supported by the body 42. A torsion spring 46 (FIG. 2) acts between the shaft and the movable jaw structure 44 to urge the latter to its closed position. A lever (not shown) extends radially from the lower end of the shaft 45 and turns the movable jaw structure 44 to its open position when the free end of the lever is engaged by a cam (not shown). Reference may be made to Lense et al U.S. Pat. No. 3,568,402 for a detailed disclosure of actuating mechanism for a bag clamp.

The body 42 of the leading clamp 13 is attached securely to the chain 15 (see FIG. 4). The body of the trailing clamp 14 is connected to a bellcrank 50 which is pivotally mounted on the chain as indicated at 51 in FIG. 4. When the pouch 10 first enters the steaming station, a swingable bar 52 is positioned as shown in FIG. 4 and engages a roller 53 on the bellcrank to keep the trailing clamp 14 shifted toward the leading clamp 13 and thus hold the pouch open. After steam has been introduced into the pouch, the bar 52 is swung counterclockwise to the position shown in FIG. 5. As an incident to such swinging, a coil spring 54 forces the bellcrank to turn clockwise about the pivot 51. Clockwise turning of the bellcrank shifts the trailing clamp away from the leading clamp to draw the panels of the pouch toward one another and thus close the pouch (see FIG. 5).

Figure 2:
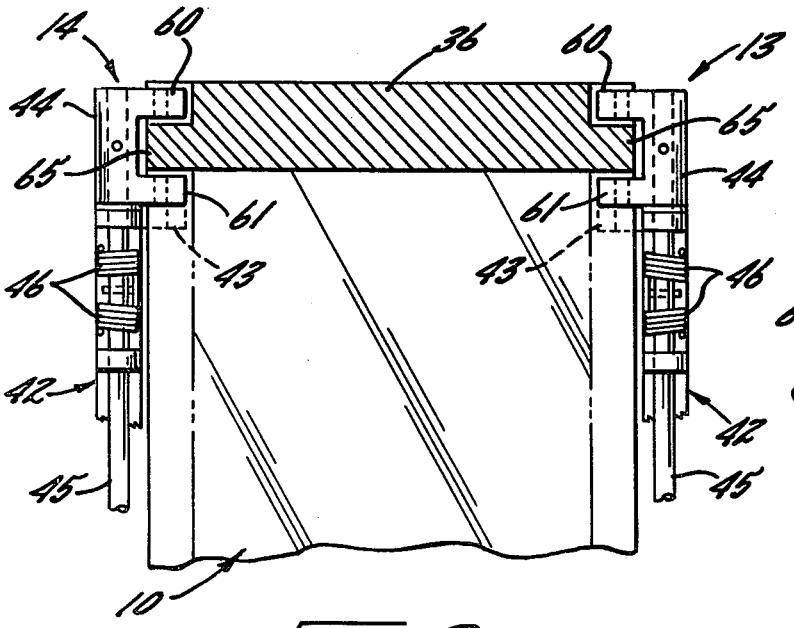
FIG. 2 is an enlarged fragmentary cross-section taken substantially along the line 2—2 of FIG. 1.
Figure 3:
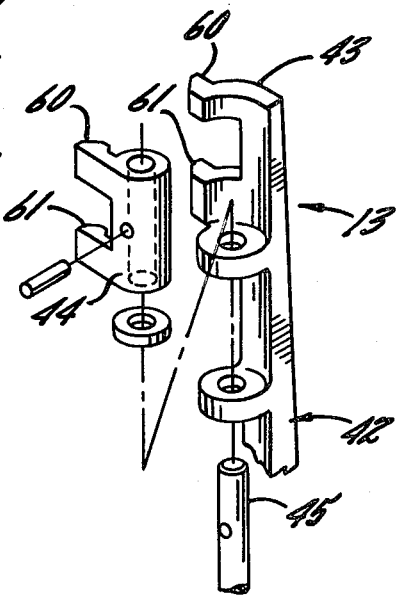
FIG. 3 is a perspective view of certain parts of one of the bag clamps.

In carrying out the invention, the fixed and movable jaw structures 43 and 44 of each clamp 13 and 14 are formed with upper and lower jaws 60 and 61 (see FIGS. 2 and 3). The jaws project horizontally and are generally C-shaped with the upper jaw of each pair forming the upper leg of the C and with the lower jaw forming the lower leg of the C. The lower jaws 61 are located just slightly below (e.g., $\frac{1}{8}$") the bottom margin 62 (FIG. 1) of the top seal area 40. Pursuant to the invention, the upper jaws 60 are located above the bottom margin 62 of the top seal area and herein are located just below the extreme top of the pouch. The upper jaws could, however, extend slightly above the extreme top of the pouch.

Being gripped at vertically spaced locations by the upper and lower jaws 60 and 61, the top portion of the pouch 10 is drawn into a substantially flat and planar condition when the trailing clamp 14 is shifted away from the leading clamp 13 to close the pouch. Moreover, the upper jaws support the extreme top of the pouch and prevent the top from drooping. Accordingly, the top of the pouch is held tightly and is less susceptible to becoming wrinkled when engaged by the seal bars 36.

To enable a complete top seal to be formed, each seal bar 36 is formed with projecting end portions 65 (FIGS. 2 and 4) which extend into the spaces between the upper and lower jaws 60 and 61. As a result of the projecting end portions, the top seal 40 spans the distance between the side seals of the pouch so as to form a complete seal across the upper end portion of the pouch.

I claim:

1. Apparatus for handling an upright pouch having upright side margins and for forming a top heat seal along the extreme upper end portion and along the top margin of the pouch, said apparatus comprising a pair of clamps for releasably gripping opposite side margins of the pouch, means for advancing said clamps and the gripped pouch along a predetermined path, each of said clamps having upper opposing jaws and having lower opposing jaws spaced below the upper jaws, a pair of opposing heated seal bars disposed on opposite sides of said path for heat sealing the extreme upper end portion of the pouch between the pair of clamps, means for moving said bars to active positions in which the bars contact opposite sides of the extreme upper end portion of the pouch to form said top heat seal, said sealing bars having oppositely extending portions projecting toward said side margins and spaced below the top ends of the bars and extending into the spaces between the upper and lower jaws of said clamps when said bars are in said active positions, the upper and lower jaws of each clamp gripping said pouch at elevations respectively located above and below the bottom margin of the top heat seal formed by said bars.

2. Apparatus as defined in claim 1 in which each of said clamps is generally C-shaped with said lower jaws defining the lower leg of the C and with said upper jaws defining the upper leg of the C.

* * * * *